US005434029A

United States Patent [19]

Moser

[11] Patent Number: 5,434,029

[45] Date of Patent: Jul. 18, 1995

[54] CURL PREVENTION METHOD FOR HIGH TMA COLOR COPIERS

[75] Inventor: Rabin Moser, Fairport, N.Y.

[73] Assignee: Xerox Corporation, Stamford, Conn.

[21] Appl. No.: 695,838

[22] Filed: May 6, 1991

[51] Int. Cl.[6] ..... G03G 13/06

[52] U.S. Cl. ..... 430/97; 430/99; 355/285; 355/290; 219/216; 118/60

[58] Field of Search ..... 430/97, 99; 355/285, 355/290; 219/216; 118/60

[56] References Cited

U.S. PATENT DOCUMENTS 4,327,174 4/1982 von Meer ..... 430/530

4,375,327 3/1983 Matsumoto et al. ..... 355/3 FU 4,652,110 3/1987 Sato et al. ..... 355/3 FU

*Primary Examiner*—Mark A. Chapman

[57] ABSTRACT

Apparatus and method of preventing the curling of a substrate having toner images electrostatically adhered thereto which substrate has been subjected to heat for the purpose of fixing the toner images to the substrate. Simultaneous constraint of the copy substrate and the application of moisture thereto is effected by passing the substrate through the nip formed by two pressure engaged rollers, one of which is utilized for applying the water to the back side of the substrate as the substrate passes through the aftermentioned nip.

9 Claims, 2 Drawing Sheets

CURL PREVENTION METHOD FOR HIGH TMA COLOR COPIERS

BACKGROUND OF THE INVENTION

This invention relates to an image recording apparatus such as a printer, copying apparatus or a composite image recording apparatus, and more particularly, it relates to the heat and pressure fixing of particulate thermoplastic toner by direct contact with a heated fusing member.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual toner image can be either fixed directly upon the photosensitive member or transferred from the member to another support, such as a sheet of plain paper, with subsequent affixing of the image thereto in one of various ways, for example, as by heat and pressure.

In order to affix or fuse electroscopic toner material onto a support member by heat and pressure, it is necessary to apply pressure and elevate the temperature of the toner to a point at which the constituents of the toner material become tacky and coalesce. This action causes the toner to flow to some extent into the fibers or pores of support members or otherwise upon the surfaces thereof. Thereafter, as the toner material cools, solidification of the toner material occurs causing the toner material to be bonded firmly to the support member. In both the xerographic as well as the electrographic recording arts, the use of thermal energy and pressure for fixing toner images onto a support member is old and well known.

One approach to heat and pressure fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the fuser roll thereby to effect heating of the toner images within the nip. A large quantity of heat is applied to the toner and the sheet bearing the toner image. This heat vaporizes the moisture contained in the sheet. Since the heat quantity applied to the front side of the sheet is not equal to that applied to the backside thereof, the amounts of the evaporation are not equal. This results in sheet curling.

High toner mass area (TMA) copies, especially colored ones where large solids in excess of 2 mg/cm$^2$ are not uncommon, acquire a degree of curl that is very difficult to live with. Various decurling structures and methods have been considered, but the solutions are at best a compromise, since copies are not usually uniformly covered with toner. Thus, with known decurling systems, decurling that is successful in an area having a high TMA would result in too much decurling in an area where there is a less toner coverage.

The problem is generally recognized as continued expansion of a paper substrate as it equilibrates with the moisture in the environment after the toner image is set in its dimensions.

Examples of structures and methods of curl prevention or decurling are as follows:

Laid-Open Japanese Patent Application No. 81270/1982 discloses, in order to solve the problem described above, that the sheet itself is improved from the standpoint of reducing the amount of curling. More particularly, the moisture content of a sheet is maintained 5.5–6.5% so as to maintain a desired rigidity in the sheet. This, however, limits the sheets which are usable, and can not satisfactorily be used with plain paper. In addition, the sheets are vulnerable to changes in ambient conditions, for example, the sheets absorb moisture under relatively high humidity conditions, resulting in less rigidity. Furthermore, when the amount of evaporation increases, the amount of curling is usually increased.

U.S. Pat. No. 4,375,327 relates to a heat fixing device including a heat fixing roller and a pressing roller, wherein a separation pawl is provided so as to contact the pressing roller, and the distance between the separation pawl and the nip between the fixing roller and the pressing roller is reduced.

Laid-Open Japanese Patent Application No. 113637/1976 discloses that the speed of sheet transportation be higher after the sheet is discharged from the nip in the fixing device than during its transportation in the fixing device.

The foregoing are not able to deal with the curling of a particular portion of the sheet or the entirety thereof. Particularly in the case of the duplex image recording, where the trailing end of the sheet in the first side printing becomes the leading edge in the second side printing, and therefore, it is necessary to regulate the curling in the neighborhood of the sheet trailing edge in the first side printing. The above-described devices are not satisfactory to meet this necessity. The '327 patent mentioned above is effective to regulate a wave-form curling, and the Japanese Laid-Open Patent Application can regulate curling only when the sheet is between the fixing roller and transporting means located downstream thereof. Thus, neither can deal with curling in the neighborhood of the leading or trailing edge of the sheet.

There are other proposals for the purpose of regulating or eliminating curling of the sheet at the discharge of the fixing roller, but they are not satisfactory in order to meet curling from the leading edge to the trailing edge.

Laid-Open Japanese Patent Application No. 143339/1978, noting that the sheet curling is the most particular problem in duplex printing, proposes that a toner image on the first side is temporarily fixed, and the toner images on the two sides are fixed to a sufficient extent when the second side toner image is fixed. During the fixing operation for the first side, that is, the temporary image fixing, the sheet does not receive a large quantity of heat so that the amount of curling is not large, but correspondingly, the image fixing is not sufficient. Those insufficiently fixed toner images may be scraped off by transporting rollers and so on during the sheet transportation for the second side image formation. As will be understood, the conditions for providing satisfactory fixing and the conditions for reduced curling, are contradictory to each other, and the conditions under which both are satisfactory are so limited that reducing the amount of curling by degrading slightly the fixing performance is practically very difficult.

Laid-Open Japanese Patent Application No. 24862/1984, discloses a water pan located above the fixing mechanism. The pan is heated by the heat emitted from the fixing mechanism after it is sufficiently heated. Thereafter, the water in the pan is heated thereby and is evaporated. In this system, a state is formed outside the copying mechanisms, wherein the water vapor is dispersed in the ambient atmosphere. Then, the sheet after being subjected to the image fixing operation is introduced in the ambience.

As will be appreciated, it requires a long time from the start of the water pan heating to the water therein becoming evaporated. The time is much longer than the time required from actuation of the main switch to the copyable state being reached. Therefore, the sheet curling could not be prevented during a significant time period from the time the copyable state is reached. Since the amount of the water contained in the water pan is necessarily limited, curl prevention is not performed after the water is consumed. It would be possible to replenish the water into the water pan, but this would require complicated mechanisms for the control because the temperature in and of the copying machine is increased by the continuous long operation.

U.S. Pat. No. 4,652,110 discloses an image forming or recording apparatus provided with an image fixing device of a heating type, which may cause curl of the recording material when the recording material is discharged from the fixing means. The causes of the curling are investigated, and a device is provided which can effectively correct or remove the curl of the recording material with a very simple structure. The device includes a passage for applying water vapor to the recording material, immediately after it is discharged from the fixing device. As a supply of the vapor, the moisture contained in the recording material is utilized.

BRIEF SUMMARY OF THE INVENTION

In accordance with the present invention, a pair of rollers similar to a fuser, operating at significantly lower load and temperature are utilized for curl prevention. The roll that contacts the back side of the copy has a water applicator sump used in a manner similar to a donor roll RAM (Release Agent Management) system in roll fusers such as that shown in U.S. Pat. No. 4,254,732. A metering blade controls the amount of water applied to the back side of the copy. The exact amount of water that comes out of a typical copy paper substrate has been determined to be approximately 150 mgs. In addition to application of water to the back side of the copy substrate, the water applying roll cooperates with the other roller to constrain the substrate while it is absorbing water. Thus, the moisture in the form of water is applied to the substrate simultaneously with the constraint of the substrate by the pressure of the pair of rollers.

DETAILED DESCRIPTION OF THE PREFERRED EMBODIMENT OF THE INVENTION

The invention wild now be described with reference to a preferred embodiment of an electrostatographic printing apparatus.

Figure 1:
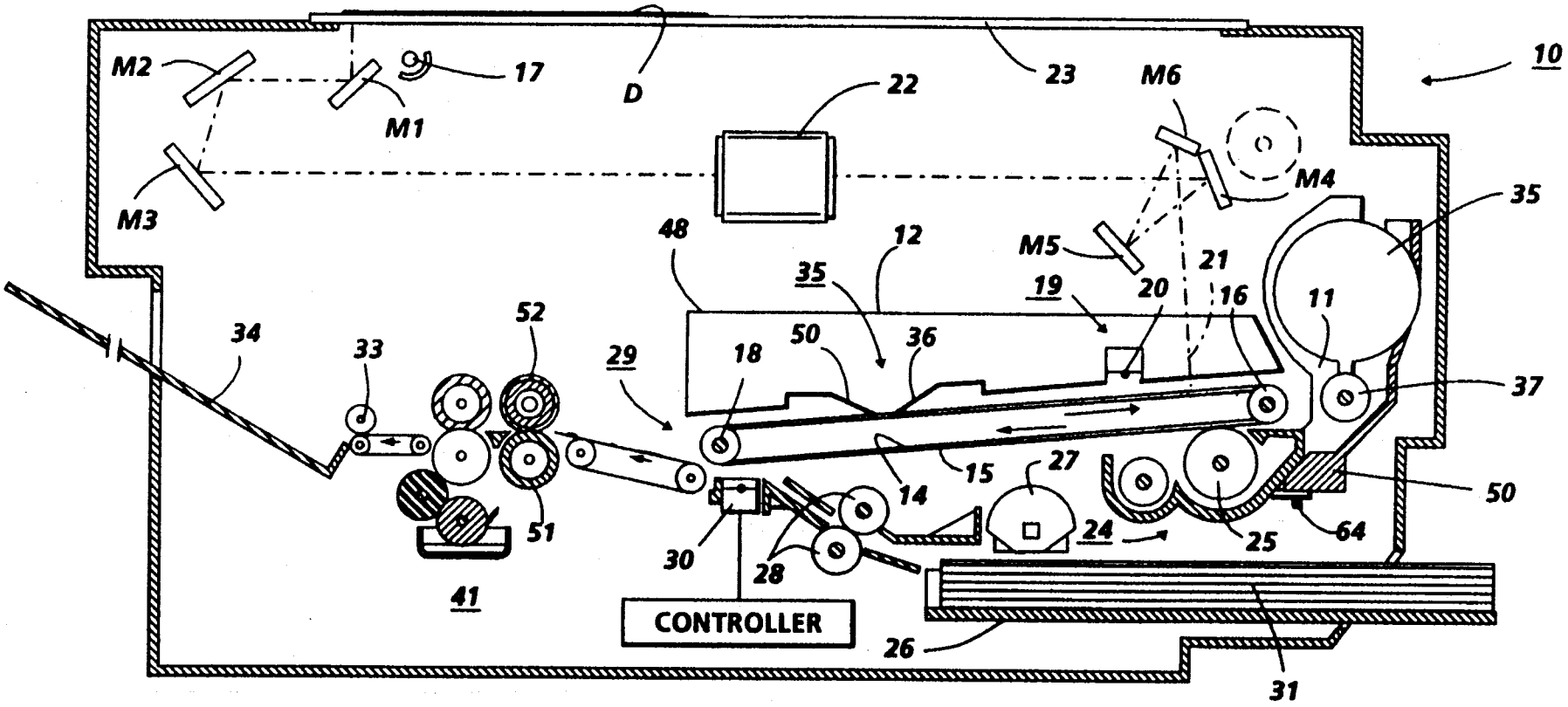
FIG. 1 is a schematic representation in cross section of an automatic electrostatographic machine in which the curl prevention device of the present invention may be used.

Referring now to FIG. 1, there is shown by way of example, an automatic electrostatographic reproducing machine 10 which includes a removable processing cartridge 12. The reproducing machine depicted in FIG. 1 illustrates the various components utilized therein for producing copies from an original document. Although the invention is particularly well adapted for use in automatic electrostatographic reproducing machines, it should become evident from the following description that it is equally well suited for use in a wide variety of processing systems including other electrostatographic systems such as printers and is not necessarily limited in application to the particular embodiment shown herein.

The reproducing machine 10 illustrated in FIG. 1 employs a removable processing cartridge 12 which may be inserted and withdrawn from the main machine frame. Cartridge 12 includes an image recording belt-like member 14 the outer periphery of which is coated with a suitable photoconductive material 15. The belt or charge retentive member is suitably mounted for revolution within the cartridge about driven transport roll 16, around idler roll 18 and travels in the direction indicated by the arrows on the inner run of the belt to bring the image bearing surface thereon past a plurality of xerographic processing stations. Suitable drive means such as a motor, not shown, are provided to power and coordinate the motion of the various cooperating machine components whereby a faithful reproduction of the original input scene information is recorded upon a sheet of final support material 31, such as paper or the like.

Initially, the belt 14 moves the photoconductive surface 15 through a charging station 19 wherein the belt is uniformly charged with an electrostatic charge placed on the photoconductive surface by charge corotron 20 in known manner preparatory to imaging. Thereafter, the uniformly charged portion of the belt 14 is moved to exposure station 21 wherein the charged photoconductive surface 15 is exposed to the light image of the original input scene information, whereby the charge is selectively dissipated in the light exposed regions to record the original input scene in the form of an electrostatic latent image.

The optical arrangement creating the latent image comprises a scanning optical system including lamp 17 and mirrors $M_1$, $M_2$, $M_3$ mounted to a scanning carriage (not shown) to scan an original document D on an imaging platen 23. Lens 22 and mirrors $M_4$, $M_5$, $M_6$ transmit the image to the photoconductive belt in known manner. The speed of the scanning carriage and the speed of the photoconductive belt are synchronized to provide faithful reproduction of the original document. After exposure of belt 14 the electrostatic latent image recorded on the photoconductive surface 15 is transported to development station 24, wherein developer is applied to the photoconductive surface 15 of the belt 14 rendering the latent image visible. The development station includes a magnetic brush development system including developer roll 25 utilizing a magnetizable developer mix having course magnetic carrier granules and toner colorant particles supplied from developer supply 11 and auger transport 37.

Sheets 31 of final support material are supported in a stack arranged on elevator stack support tray 26. With the stack at its elevated position, a segmented feed and sheet separator roll 27 feeds individual sheets therefrom to a registration pinch roll pair 28. The sheet is then forwarded to a transfer station 29 in proper registration with the image on the belt and the developed image on the photoconductive surface 15 is brought into contact with the sheet 31 of final support material within the transfer station 29 and the toner image is transferred from the photoconductive surface 15 to the contacting side of the final support sheet 31 by means of transfer corotron 30. Following transfer of the image, the final support material which may be paper, plastic, etc., as desired, is separated from the belt due to the beam strength of the support material 31 as it passes around the idler roll 18. The sheet containing the toner image thereon is advanced to fixing station 41 comprising heated fuser roll 52 and pressure roll 51 forming a nip therebetween wherein roll fuser 52 fixes the transferred powder image thereto.

Although a preponderance of toner powder is transferred to the final support material 31, invariably some residual toner remains on the photoconductive surface 15 after the transfer of the toner powder image to the final support material. The residual toner particles remaining on the photoconductive surface after the transfer operation are removed from the belt 14 at a cleaning station 35 which comprises a cleaning blade 36 in scrapping contact with the outer periphery of the belt 14. The particles so removed are contained within cleaning housing 48 which has a cleaning seal 50 associated with the upstream opening of the cleaning housing. Alternatively, the toner particles may be mechanically cleaned from the photoconductive surface by a cleaning brush as is well known in the art.

It is believed that the foregoing general description is sufficient for the purposes of the present invention to illustrate the general operation of an automatic xerographic copier 10 which can embody the apparatus in accordance with the present invention.

Figure 2:
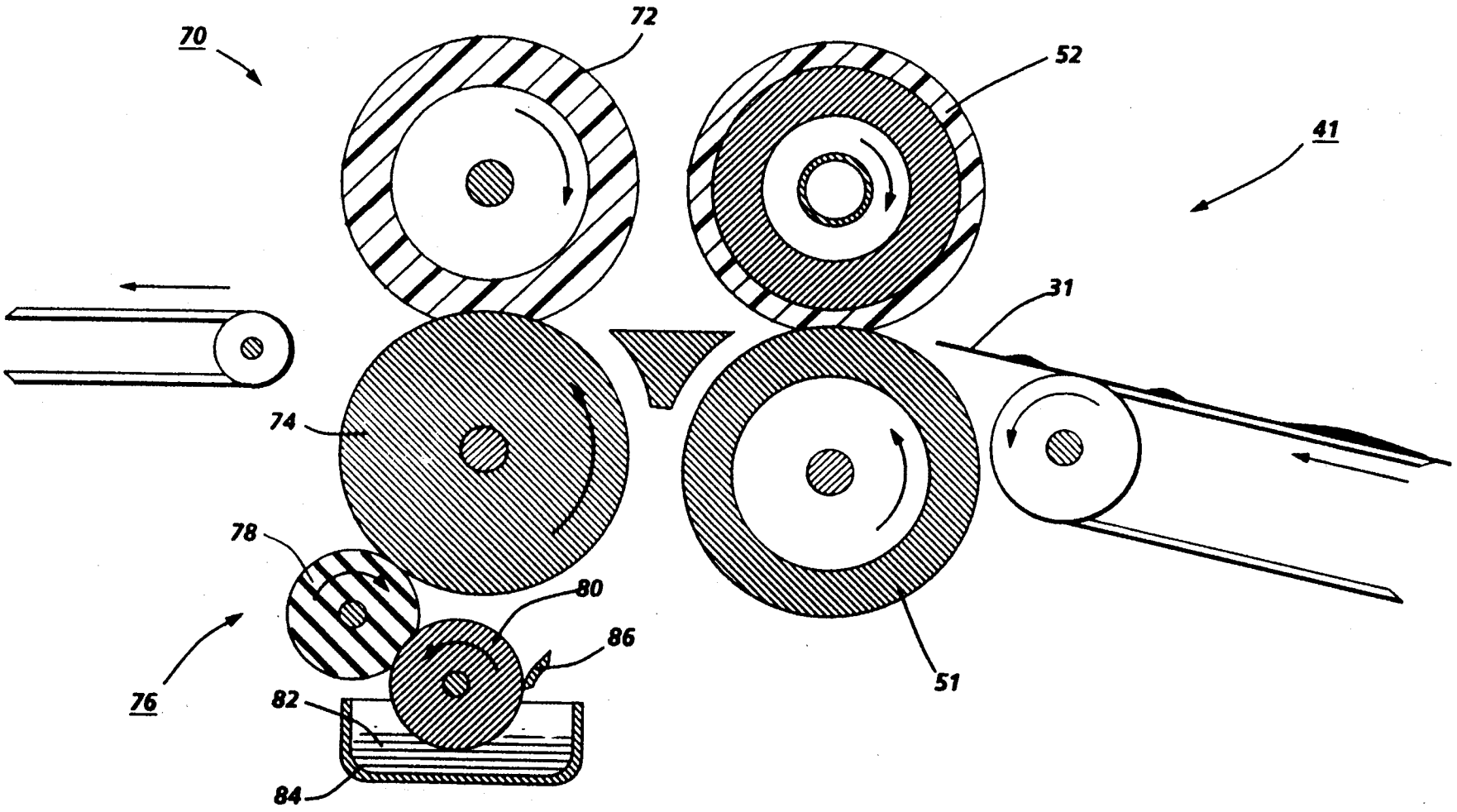
FIG. 2 is schematic representation of a heat and pressure fuser and curl prevention device of the present invention.

In accordance with the present invention as shown in FIGS. 1 and 2, a curl prevention device generally indicated by reference numeral 70 is provided. The curl prevention device 70 comprises a pair of rollers 72 and 74 constructed similarly to the heat and pressure fuser rollers 51 and 52. The rollers 72 and 74 are operated at a significantly lower load and temperature than the fuser rollers 51 and 52.

A water applicator structure 76 serves to apply water to the back side of the copy substrate 31. The water applicator structure comprises a metering roller 80 which transfers water to the intermediate or donor roller 78 which transfers water to the pressure roller contacting the back side of the copy substrate. The metering roller 80 is partially submerged in water 82 contained in a sump 84. The metering roller 80 is supported in pressure engagement with the donor roller 78 so that it is rotated thereby. Rotational movement of the metering roller is effected through pressure engagement with the applicator roller 74 as the latter is rotated via a drive mechanism, not shown. Friction alone may be sufficient to obviate the need for a separate drive. A metering blade 86 contacting the roller 80 serves to meter a predetermined amount of water thereto. The water applicator structure 76 is similar to the donor RAM structure disclosed in U.S. Pat. No. 4,254,732 granted to Rabin Moser on Mar. 10, 1981.

Measurements have shown that approximately 150 mgs. of water is typically lost from an $8\frac{1}{2}\times 11$ sheet of copy paper during the fusing operation. Thus, approximately 150 mgs. of water is applied to the back side of the copy substrate. However a smaller amount may be adequate under certain conditions An important aspect of the present invention resides in the application of the water to the back side of the copy substrate while the copy substrate is constrained by the pair of rollers.

After fusing the toner image to the copy sheet and treating it with water, the sheet 31 is advanced by output rolls 33 to sheet stacking tray 34.

What is claimed is:

1. Fuser apparatus, said apparatus comprising:

a heated roll structure;

a pressure roll structure cooperating with said heated roll structure to form a nip through which copy substrates pass with toner images carried thereby containing said heated roll structure;

a supply of liquid;

means supported down stream of said heated and pressure roll structures for applying said liquid to the substrates by direct contact therewith; and means for constraining a substrate during application of said liquid.

2. Apparatus according to claim 1 wherein said liquid comprises water.

3. Apparatus according to claim 2 wherein said means for applying said water comprises a roll structure.

4. Apparatus according to claim 3 wherein said means for constraining a substrate comprises a pair of roll structures forming a nip through which said substrate passes, said means for applying said water comprising one of said pair of roll structures.

5. A method of preventing curling of substrates to which toner images have been fixed using heat, said method including the steps of:

providing a heated roll structure;

providing a pressure roll structure cooperating with said heated roll structure to form a nip through which copy substrates pass with toner images carried thereby contacting said heated roll structure;

applying liquid by directly contacting one surface of a substrate; and physically constraining said substrates during application of said liquid.

6. The method according to claim 5 wherein said liquid comprises water.

7. The method according to claim 6 wherein said step of applying said water comprises using a roll structure.

8. The method according to claim 7 wherein said step of constraining a substrate comprises using a pair of roll structures forming a nip through which said substrate passes, said means for applying said water comprising one of said pair of roll structures.

9. The method according to claim 5 wherein said step of applying said liquid further comprises a donor roll and a metering roll, the latter of which contacts water contained in a sump and the former of which conveys water from the metering roll to the the roll structure which contacts the substrate.

* * * * *